United States Patent [19]

Okuzawa

[11] Patent Number: 4,888,617

[45] Date of Patent: Dec. 19, 1989

[54] SHEET FEEDING MECHANISM FOR AN IMAGE RECORDING DEVICE

[75] Inventor: Tugio Okuzawa, Ashigarakami, Japan

[73] Assignee: Fuji Photo Film Co., Ltd., Kanagawa, Japan

[21] Appl. No.: 164,026

[22] Filed: Mar. 4, 1988

[30] Foreign Application Priority Data

Mar. 5, 1987 [JP] Japan ..... 62-50858

[51] Int. Cl.[4] ..... G03G 21/00; B65H 7/08; B65H 1/08; B65H 1/16

[52] U.S. Cl. ..... 355/203; 271/110; 271/127; 271/154; 355/309

[58] Field of Search ..... 355/35 H, 145 H, 203, 355/309; 271/110, 127, 126, 154, 155

[56] References Cited

U.S. PATENT DOCUMENTS 3,655,183 4/1972 Wagner ..... 271/155
4,253,654 3/1981 Buys ..... 271/155
4,500,199 2/1985 Kasuga et al. ..... 355/35 H X
4,503,960 3/1985 Koeleman et al. ..... 355/14 S H X
4,566,547 1/1986 Furukawa ..... 355/14 S H X
4,698,650 10/1987 Watanabe et al. ..... 355/14 S H X

FOREIGN PATENT DOCUMENTS 0126369 10/1979 Japan ..... 355/3 S H
0262756 12/1985 Japan ..... 271/127

*Primary Examiner*—A. T. Grimley
*Assistant Examiner*—Edward Pipala
*Attorney, Agent, or Firm*—Sughrue, Mion, Zinn, Macpeak & Seas

[57] ABSTRACT

An image recording device for forming an image on an image receptive member includes a casing for storing a stack of image receptive sheets, a sheet feed roller for delivering one image receptive member at a time from the casing, a movable plate disposed in the casing and displaceable toward the sheet feed roller as the number of the image receptive members in the casing is reduced, and a detector mechanism for detecting a predetermined amount of displacement of the movable plate. An image recorded on a photosensitive member is transferred to the image receptive member delivered by the sheet feed roller.

8 Claims, 3 Drawing Sheets

SHEET FEEDING MECHANISM FOR AN IMAGE RECORDING DEVICE

BACKGROUND OF THE INVENTION

The present invention relates to an image recording device, and more particularly to an image recording device in which image receptive members are delivered one by one from a stack, and images recorded on a photosensitive member are transferred to the image receptive members for form images on the latter, the image recording device being capable of detecting a shortage of remaining image receptive members for allowing wasteless and efficient image formation.

One example of image recording member in the form of microcapsules containing a photosensitive composition is disclosed in Japanese Laid-Open patent publication No. 57-179836. The disclosed image recording member is a photosensitive member which employs capsules having a synthetic high-molecular resin wall containing a vinyl compound, a photopolymerization starter, and a colorant precursor. With this photosensitive member, microcapsules are hardened in the pattern of an image through exposure, and then the microcapsules which have not been hardened are broken under pressure to discharge the colorant precursor which then forms a colored image. A high-quality image can be obtained by a simple dry-type process. However, the disclosed photosensitive member is much lower in photosensitivity than photosensitive members which use silver halides such as photographic emulsions.

There has been developed a novel photosensitive member which has high sensitivity and can be processed to produce a high-quality image through a simple dry-type process (see U.S. patent application Ser. No. 868385). The photosensitive member comprises a support coated with a photosensitive silver halide, a reducing agent, a polymerizable compound, and a color-image-forming material. At least the polymerizable compound and the color-image-forming material are encased in one microcapsule.

An image recording device for recording an image using such a photosensitive member is disclosed in detail in U.S. patent application Ser. No. 942654. In the disclosed image recording device, the photosensitive member is exposed to an image to produce a latent image thereon. Then, the photosensitive member is heated to develop the image by polymerizing the polymerizable compound in an area where the latent image is present, thus generating a high-molecular compound to harden microcapsules. Finally, the photosensitive member is superposed under pressure on an image receptive member having an image receptive layer to which a color-image-forming material can be transferred, so that at least some of microcapsules in an area where no latent image is present are broken to transfer the color-image-forming material to the image receptive member for thereby forming a visible image.

In the image recording device, the photosensitive member is fed through an exposure unit for forming a latent image and a heat development unit for heating the photosensitive member, after which the photosensitive member is superposed on the image receptive member. The image receptive member, on the other hand, is not especially treated until the photosensitive member is superposed on the image receptive member. To meet demands for a smaller device size and layout requirements, the feed path for the image receptive member is usually shorter than the feed path for the photosensitive member. Therefore, if the image recording device ran short of any image receptive member while the photosensitive member is being exposed or heated, no image would be transferred from the photosensitive member that has been exposed, and the photosensitive member would be superposed on no image receptive member, with the result that the color-image-forming material would be deposited at various locations in the image recording device.

Various countermeasures have heretofore been proposed to avoid the aforesaid drawbacks. For example, a certain number of image receptive members are loaded in the image recording device, and those image receptive members which are supplied for operation in the device are counted by a sensor or the like so that the remaining number of image receptive members can be detected. When a predetermined number of remaining image receptive members are detected, the exposure process of the photosensitive member is interrupted. In this manner, the problems as described above can be avoided.

However, if two or more image receptive members are fed at a time, then the detected number of remaining image receptive members is false, and image transfer may be made impossible. Accordingly, a mechanism for detecting feeding of two or more image receptive members at a time is required rendering the overall arrangement complex. Where a means for storing data on the remaining number of image receptive members is an electric means such as an IC memory or the like, a backup power supply should be provided to protect the stored data when the image developing device is not in operation.

According to another proposal, recesses or the like are defined in some image receptive members near the end of their stack, and whether the device is running short of image receptive members can be detected by sensing the recesses. This arrangement is not economical since special image receptive members are needed for detecting purpose.

SUMMARY OF THE INVENTION

It is a principal object of the present invention to provide an image recording device in which image receptive members are fed one by one from a loaded stack and images recorded on a photosensitive member are transferred to the image receptive members to form images on the image receptive members, the image receptive members being stacked on a movable plate, whereby a shortage of remaining image receptive members can be detected from the amount of displacement of the movable plate due to a reduction in the number of image receptive members as they are fed out, with the result that the shortage can accurately be detected by a simple arrangement and any supply failure of image receptive members can be avoided in advance for efficient image recording operation.

Another object of the present invention is to provide an image recording device for forming an image on an image receptive member, comprising: a casing for storing a stack of image receptive members; delivery means for delivering one image receptive member at a time from the casing: a movable plate disposed in the casing and displaceable toward the delivery means as the number of the image receptive members in the casing is reduced; a detector mechanism for detecting a predetermined amount of displacement of the movable plate; and transferring means for transferring an image recorded on a photosensitive member to the image receptive member delivered by the delivery means.

Still another object of the present invention is to provide an image recording device wherein the movable plate is angularly movable about one end thereof in the casing, further including a resilient member for normally urging an opposite end of the movable plate toward the delivery means, the image receptive members being stacked on an upper surface of the movable plate.

Yet another object of the present invention is to provide an image recording device wherein the resilient member comprises a conical coil spring progressively smaller in diameter toward the delivery means.

Yet still another object of the present invention is to provide an image recording device wherein the casing has a tooth disposed on an upper edge thereof near the opposite end of the movable plate for engaging an end of an uppermost one of the image receptive members.

A further object of the present invention is to provide an image recording device wherein the detector mechanism comprises an arm angularly movably supported centerally thereof and having an end displaceable in response to displacement of the movable plate, and detecting means for detecting a predetermined amount of displacement of the arm.

A still further object of the present invention is to provide an image recording device wherein the detecting means comprising a pair of support plates defining a slit therebetween into which an opposite end of the arm can enter, and a light-emitting element and a light detector supported respectively on the support plates in confronting relation.

A yet further object of the present invention is to provide an image recording device wherein the detecting means is positionally adjustable in a direction in which the opposite end of the arm is displaceable.

A yet still further object of the present invention is to provide an image recording device wherein the movable plate has a tongue projecting from one side thereof, the end of the arm being held against the tongue.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Photosensitive members that can be employed in an image recording device according to the present invention will first be described.

One photosensitive member which can be used may be of the type disclosed in Japanese Laid-Open patent publication No. 57-179836. According to this type, a polymerizable compound is hardened in the pattern of an image upon exposure, and then pressure is applied to obtain a visible image. The photosensitive member comprises a suport carrying capsules having a synthetic high-molecular resin wall containing a vinyl compound, a photopolymerization starter, and a colorant precursor.

Another photosensitive member is of the type in which a latent image formed by exposure to an image is preliminarily developed thermally in a wet-type process, and thereafter pressure is applied to develop a visible image. One example of this photosensitive member is disclosed in Japanese Laid-Open patent publication No. 61-278849. After the thermal image development, a color-image-forming material is transferred onto an image receptive member having an image receptive layer to produce an image on the image receptive member. The disclosed photosensitive member comprises a support coated with a photosensitive silver halide, a reducing agent, a polymerizable compound, and a color-image-forming material. At least the polymerizable compound and the color-image-forming material are encased in one microcapsule.

Still another photosensitive member is a thermal development photosensitive member. Various types of thermal development photosensitive member are known. In one type, movable dye is discharged with heat into an image pattern, and transferred by a solvent such as water to an image receptive member (dye fixing member) having a mordant. In another type, an image is transferred to an image receptive member by an organic solvent having a high boiling point. According to still another type, an image is transferred to an image receptive member by a hydrophilic thermal solvent included in the image receptive member. According to a further photosensitive member, movable dye which is thermally diffusive or sublime is transferred to a dye receiving member such as a support. These photosensitive members are disclosed in U.S. Pat. Nos. 4463079, 4474867, 4478927, 4507380, 4500626, 4503137, 4483914 and 4559290, U.S. patent application Ser. Nos. 471073, 471375, 592195, 876665 and 590592, Japanese Laid-Open patent publication Nos. 59-165054, 59-180548, 59-168439 and 59-174834.

Figure 1:
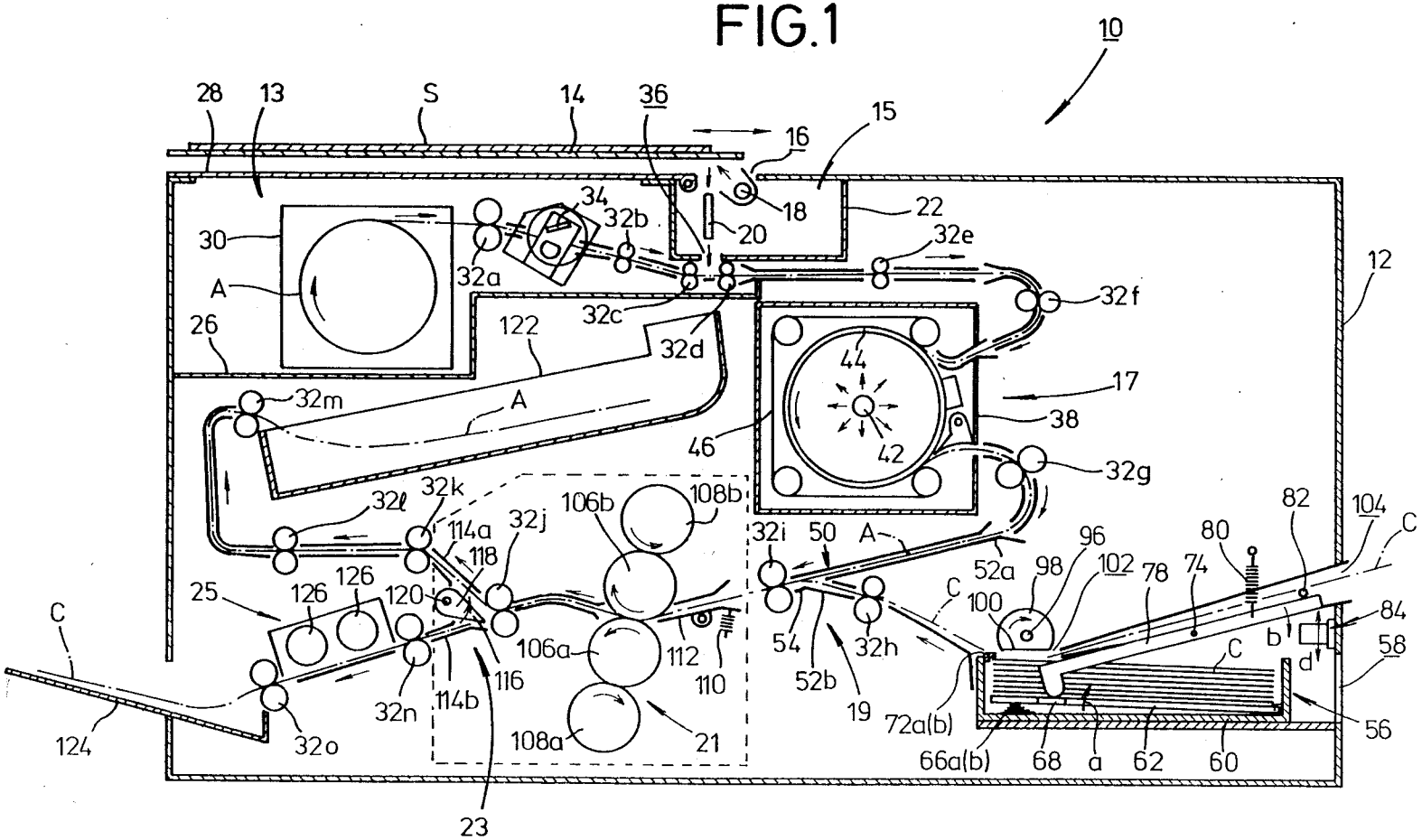
FIG. 1 is a schematic cross-sectional view of an image recording device according to the present invention.

As shown in FIG. 1, an image recording device 10 including a housing 12 accommodating therein a photosensitive member supply unit 13 housing a photosensitive member A, an image reading unit 15 for reading image information carried on an original S, a thermal developing unit 17 for heating the photosensitive member A, a superposing unit 19 for superposing an image receptive sheet C of paper on the photosensitive member A, a pressure transferring unit 21 for pressing the image receptive sheet C and the photosensitive member A against each other, a peeling unit 23 for peeling the image receptive sheet C from the photosensitive member A, and a fixing unit 25 for fixing an image on the image receptive sheet C.

The original S is placed on a transparent support glass sheet 14 on an upper panel of the housing 12. The support glass sheet 14 is reciprocally movable over an opening 14 defined in an upper surface of the image reading unit 15 in the directions of the arrow by means of a feed means (not shown). The image reading unit 15 includes a light source 18 for illuminating the original S through the opening 16, and a focusing optical system 20, the light source 18 and the focusing optical system 20 being surrounded by a partition 22.

The photosensitive member supply unit 13 is disposed in an upper portion of the housing 12 and shielded from light by a partition 26. The photosensitive member supply unit 13 is loaded with a magazine 30 containing a coil of photosensitive member A through an openable cover 28 attached to the upper panel of the housing 12. The photosensitive member A comprises a support coated with a photosensitive silver halide, a reducing agent, a polymerizable compound, and a color-image-forming material. At least the polymerizable compound and the color-image-forming material are encased in one microcapsule.

The photosensitive member supply unit 13 has first through fourth roller pairs 32*a* through 32*d* for feeding the photosensitive member A from the magazine 30 to the image reading unit 15. Between the first and second roller pairs 32*a*, 32*b*, there is disposed a cutter 34 for cutting off the photosensitive member A to a prescribed length. The partition 22 of the image reading unit 15 has an exposure opening 36 defined therein and positioned between the third and fourth roller pairs 32*c*, 32*d*.

The thermal developing unit 17 which includes a thermally insulative partition 38 is disposed below the image reading unit 15. The thermal developing unit 17 is supplied with the photosensitive member A via the image reading unit 15 through fifth and sixth roller pairs 32*e*, 32*f*. The thermal developing unit 17 includes a heating drum 44 in the form of a hollow cylinder housing a halogen lamp 42, and an endless belt 46 held against an outer peripheral surface of the heating drum 44. The heating drum 44 and the endless belt 46 grip and feed the photosensitive member A therebetween while heating the same.

The photosensitive member A fed from the thermal developing unit 17 is delivered into the superposing unit 19 via a seventh roller pair 32*g*. The superposing unit 19 has a Y-shaped guide plate assembly 50 including a first feed passage 52*a* near the seventh roller pair 32*g*, a second feed passage 52*b* near an eighth roller pair 32*h*, and an outlet passage 54 near a ninth roller pair 32*i*, the first and second feed passages 52*a*, 52*b* being joined to the outlet passage 54.

Figure 2:
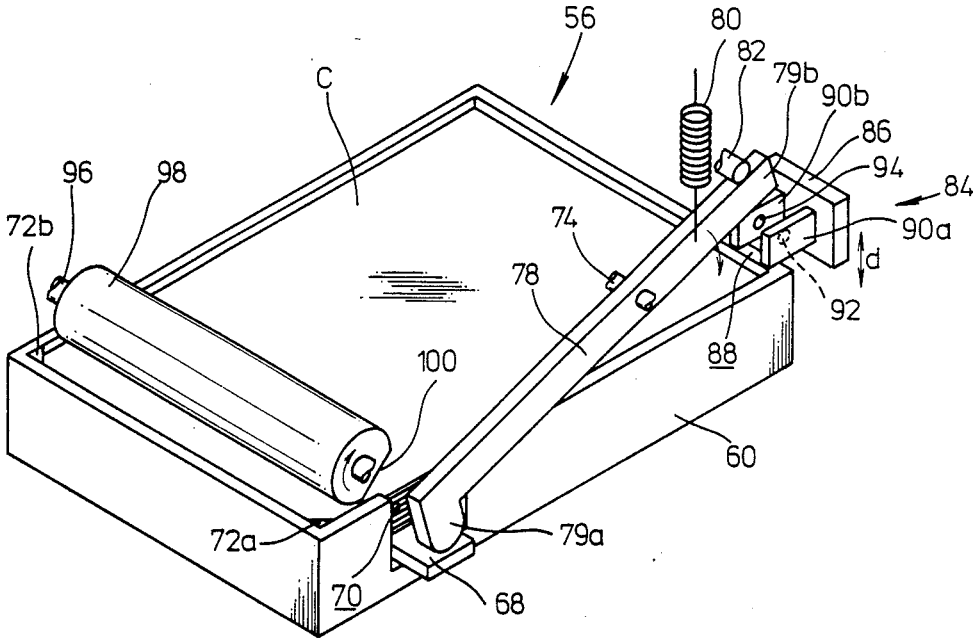
FIG. 2 is a perspective view of a shortage detecting mechanism for detecting an image receptive member shortage in the image recording device.
Figure 3:
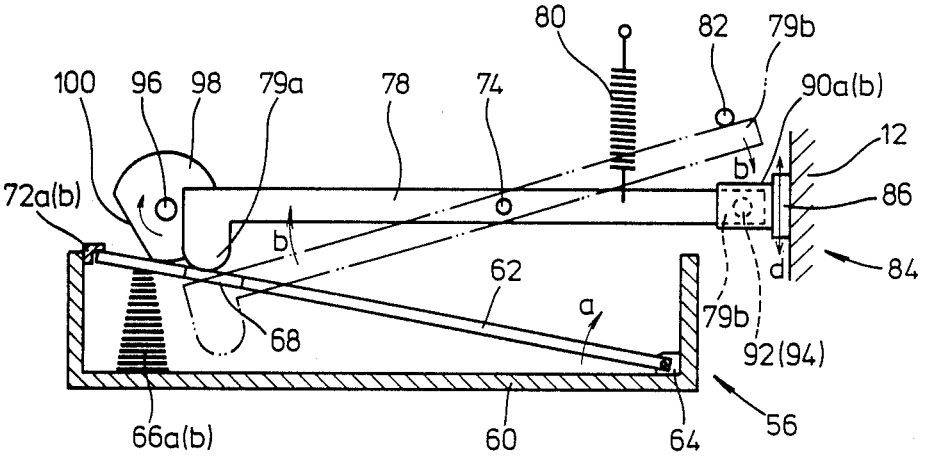
FIG. 3 is a side elevational view, partly in cross section, of the shortage detecting mechanism.

A cassette 56 housing stacked image receptive sheets C of paper is loaded into a lower corner of the housing 12 through a loading slot 58. The cassette 56 is constructed as shown in FIGS. 2 and 3. The cassette 56 has a casing 60 housing the stacked image receptive sheets C, a movable plate 62 disposed in the casing 60. The movable plate 62 has one end, near the loading slot 58, pivotally mounted on a bottom corner of the casing 60 by means of a hinge 64. Conical coil springs 66*a*, 66*b* are interposed between the other end of the movable plate 62 and the bottom of the casing 60, the coil springs 66*a*, 66*b* having their diameter progressively smaller toward the movable plate 62. At least one side of the movable plate 62 has a tongue 68 projecting out of the cassette 56 through a recess 70 defined in a side wall of the casing 60. The image receptive sheets C are placed on the movable plate 60. Upper corners of the stack of the image receptive sheets C are engaged by corner teeth 72*a*, 72*b* attached to corners of an upper edge of the casing 60 close to the other end of the movable plate 62.

An arm 78 which is angularly movably supported at its center by a pivot shaft 74 is disposed in a space above the cassette 56 on the side thereof where the tongue 68 projects. The arm 78 has an L-shaped end 79*a* which is pressed against the tongue 68 under the tension of a coil spring 80 acting on the other end portion of the arm 78. A detector 84 that is positionally adjustable in the direction of the arrow d is disposed in the vicinity of the other end 79*b* of the arm 78. The detector 84 includes an attachment plate 86 mounted on the housing 12 and a pair of support plates 90*a*, 909*b* defining a slit 88 therebetween through which the other end 79*b* of the arm 78 can pass. The support plates 90*a*, 90*b* support a light detector 92 such as a photodiode and a light-emitting element 94 such as a light-emitting diode, respectively, thereon in confront relation. A stopper pin 82 is disposed upwardly of the other end 79*b* of the arm 78 for limiting the angular range of movement of the arm 78.

A sheet feed roller 98 rotatable about a support shaft 96 is positioned upwardly of the cassette 56 near the corner teeth 72*a*, 72*b*. One image receptive sheet C at a time is taken out of the cassette 56 and supplied into the superposing unit 19 by the sheet feed roller 98. The sheet feed roller 98 has a recess 100 defined therein parallel to the support shaft 96. As shown in FIG. 1, the recess 100 defines a gap 102 between the sheet feed roller 98 and the uppermost image receptive sheet C. The housing 12 has a manual insertion slot 104 defined above the loading slot 58 for allowing the operator to manually insert an image receptive sheet C into the gap 102.

The pressure transferring unit 21 is positioned rearwardly of the ninth roller pair 32*i*. The pressure transferring unit 21 comprises a pair of first and second pressing rollers 106*a*, 106*b* pressed against each other, and first and second backup rollers 108*a*, 108*b* pressed against the backs of the pressing rollers 106*a*, 106*b* for adjusting the pressing forces produced between the pressing rollers 106*a*, 106*b*. A blade 112 biased by a coil spring 110 is located laterally of the peripheral surface of the pressing roller 106*b* for introducing the photosensitive member A and the image receptive sheet C between the pressing rollers 106*a*, 106*b*.

The peeling unit 23 is disposed rearwardly of the pressure transferring unit 21 with a tenth roller pair 32*j* interposed therebetween. More specifically, first and second feed passages 114*a*, 114*b* defined in a Y shape by gudie plates are disposed behind the tenth roller pair 32*f*. Between the first and second feed passages 114*a*, 114*b*, there is positioned a peeling finger 118 angularly movably supported by a pivot shaft 120 and having a pointed end 116 directed toward the tenth roller pair 32*j*.

The first feed passage 114*a* leads to a disposal tray 122 through eleventh through thirteenth roller pairs 32*k* through 32*m*, the disposal tray 122 being positioned below the photosensitive member supply unit 13 for receiving the photosensitive member A. The second feed passage 114*b* leads to a discharge tray 124 through fourteenth and fifteenth roller pairs 32*n*, 32*o*, the discharge tray 124 being positioned at a lower corner of the housing 12 for receiving the image receptive sheet C. The fixing unit 25 which has an ultraviolet lamp 126 is disposed between the fourteenth and fifteenth roller pairs 32*n*, 32*o*.

Operation and advantages of the image recording device which is basically constructed as described above will be described below.

The original S bearing image information is placed on the support glass sheet 14, and then fed in an auxiliary scanning direction by the feed means (not shown). At this time, the light source 18 in the image reading unit 15 is energized to apply illuminating light through the opening 16 and the support glass sheet 14 to the original S. The photosensitive member A unwound from the magazine 30 loaded in the photosensitive member supply unit 13 is fed by the first through fourth roller pairs 32*a* through 32*d* to move along the exposure opening 36 at the same speed as that of the support glass sheet 14.

Light reflected from the image information on the original S is applied to the photosensitive member A through the focusing optical system 20 and the exposure opening 36 in a main scanning direction to form a latent image on the photosensitive member A. The photosensitive member A pulled from the magazine 30 to a predetermined length is cut off by the cutter 34.

After image exposure, the photosensitive member A which is cut off is introduced into the thermal developing unit 17 by the fifth and sixth roller pairs 32*e*, 32*f*. In the thermal developing unit 17, the photosensitive member A is fed along while being gripped between the heating drum 44 and the endless belt 46, during which time the photosensitive member A is heated by the halogen lamp 42. As a result, the polymerizable compound in the area of the latent image is polymerized to harden microcapsules in the photosensitive member A.

Thereafter, the photosensitive member A is introduced from the first feed passages 52*a* of the Y-shaped guide plate assembly 50 into the superposing unit 19 by the seventh roller pair 32*g*. One of the image receptive sheets C stored in the cassette 56 loaded in the image recording device 10 is taken, one at a time, from the cassette 56 by the sheet feed roller 98 which rotates in the direction of the arrow. The image receptive sheet C is delivered through the eighth roller pair 32*h* from the second feed passage 52*b* of the Y-shaped guide plate assembly 50 into the superposing unit 19, in which the image receptive sheet C is held against the lower surface of the photosensitive member A. The photosensitive member A and the image receptive sheet C as they are superposed on each other are positioned adjusted such that the leading end of the photosensitive member A projects more toward the ninth roller pair 32*i* than the image receptive sheet C.

The remaining image receptive sheets C in the cassette 56 is checked at all times for a shortage by the arm 78 and the detector 84 which jointly constitute a detector mechanism. More specifically, when a sufficient number of image receptive sheets C are contained in the cassette 56, the movable plate 62 in the casing 60 is pressed downwardly near the bottom of the casing 60, as shown in FIG. 1, since the leading end of the uppermost image receptive sheet C is engaged by the corner teeth 72*a*, 72*b*. As the image receptive sheets C are progressively discharge out by the sheet feed roller 98 and reduced in number, the movable plate 62 is turned in the direction of the arrow a (FIG. 3) about the pin 64 under the resiliency of the conical coil springs 66*a*, 66*b*.

As described above, the conical springs 66*a*, 66*b* are progressively reduced in diameter toward the movable plate 62. Therefore, when the ends of the conical coil springs 66*a*, 66*b* which contact the lower surface of the movable plate 62 follow an arcuate path upon angular movement of the movable plate 62, the conical coil springs 66*a*, 66*b* are easily deformed to follow the arcuate path. As a consequence, the pressing forces applied by the coil springs 66*a*, 66*b* to the movable plate 62 are kept at a substantially constant level, and hence the image receptive sheets C will be fed out under optimum conditions at all times.

The end 79*a* of the arm 78 is always held in contact with the tongue 68 on the side of the movable plate 62 under the tension of the coil spring 80. The arm 78 is angularly moved in the direction of the arrow b about the pivot shaft 74 as the movable plate 62 ascends. When the arm 78 is turned a prescribed interval, the other end 79*b* thereof enters the slit 88 of the detector 84 mounted on the housing 12. At this time, a light beam emitted from the light-emitting element 94 on the support plate 90*b* is cut off by the end 79*b* of the arm 78, so that the light beam is not detected by the light detector 92.

The detector 84 now detects that the cassette 56 runs short of image receptive sheets C, and issues a command to enable the photosensitive member supply unit 13 to stop supplying the photosensitive member A. The detected shortage of image receptive sheets C may be indicated on a control panel so that the operator can immediately load additional image receptive sheets C for continued image recording operation. The remaining number of image receptive sheets C at the time a shortage thereof is to be detected can be selected as desired by positioning adjusting the detector 84 in the direction of the arrow d. The remaining number of image receptive sheets C may preferably be selected in view of the length from the cassette 56 to the superposing unit 19 and the length of the feed path from the photosensitive member supply unit 13 via the thermal developing unit 17 to the superposing unit 19.

At the time the shortage of remaining image receptive sheets C is detected, the exposure of the photosensitive member A is interrupted, and image information on the photosensitive member A which has been exposed or thermally processed is transferred to the remaining image receptive sheets C. After new image receptive sheets C have been loaded, the photosensitive member A starts to be exposed. In this manner, all image receptive sheets C stored in the cassette 56 can be used up.

An image receptive sheet C may be manually supplied by the operator through the manual insertion slot 104 into the superposing unit 19 when the shortage is detected. The image receptive sheet C thus inserted from the manual insertion slot 104 is introduced into the gap 102 (FIG. 1) defined by the recess 100 of the sheet feed roller 98. Upon rotation of the sheet feed roller 98 in the direction of the arrow, the image receptive sheets C stored in the cassette 56 are not fed out, but the manually inserted image receptive sheet C is fed into the superposing unit 19 by the sheet feed roller 98.

The photosensitive member A and the image receptive sheet C as they are fed from the outlet passage 54 of the superposing unit 19 while they are being superposed on each other are introduced into the pressure transferring unit 21 by the ninth roller pair 32*i*. In the pressure transferring unit 21, the first and second pressing rollers 106*a*, 106*b* are pressed against each other, and the photosensitive member A and the image receptive sheet C are inserted between the first and second pressing rollers 106*a*, 106*b*. The blade 112 has an end held against the outer peripheral surface of the second pressing roller 106*b* by the coil spring 110. Therefore, the photosensitive member A and the image receptive sheet C can be inserted between the pressing rollers 106*a*, 106*b* without being peeled off each other.

When the photosensitive member A and the image receptive sheet C are pressed together by the pressing rollers 106*a*, 106*b*, microcapsules in the area where no latent image is present in the photosensitive member A are broken to transfer the color-image-forming material to the image receptive sheet C for thereby forming an image. Desired pressing forces can be developed between the first and second pressing rollers 106*a*, 106*b* by suitably adjusting the pressure applied to the backs of the pressing rollers 106*a*, 106*b* by the first and second backup rollers 108*a*, 108*b*, so that the image can be formed highly accurately.

The photosensitive member A and the image receptive sheet C that have been pressed together by the pressure transferring unit 21 are then introduced into the peeling unit 23 through the tenth roller pair 32*j*. In the peeling unit 23, the peeling finger 118 is turned in the direction of the arrow about the pivot shaft 120 to peel the photosensitive member A and the image receptive sheet C from each other. More specifically, since the leading end of the photosensitive member A projects more than the leading end of the image receptive sheet C, the photosensitive member A is fed toward the first feed passage 114*a* by the pointed end 116 of the peeling finger 118. The image receptive sheet C is separated from the photosensitive member A by the pointed end 116 of the peeling finger 118 and delivered into the second feed passage 114*b*.

The image receptive sheet C fed into the second feed passage 114*b* is sent into the fixing unit 25 by the fourteenth roller pair 32*n*. The image transferred to the surface of the image receptive sheet C is then fixed by the ultraviolet lamp 126 in the fixing unit 25. Thereafter, the image receptive sheet C is discharged onto the discharge tray 124 by the fifteenth roller pair 32*o*. The photosensitive member A delivered into the first feed passage 114*a* is fed onto the disposal tray 122 by the eleventh through thirteenth roller pairs 32*k* through 32*m*.

With the present invention, as described above, image receptive members or sheets which are loaded as a stack are fed one by one, and an image recorded on a photosensitive member is transferred to the image receptive member to form an image thereon. The loaded image receptive members are stacked on a movable plate which is displaced as the stacked image receptive members are progressively reduced in number. A predetermined amount of displacement of the movable plate is detected by a detector mechanism. Accordingly, the detector mechanism can detect when a shortage of remaining image receptive members occurs accurately irrespective of the number of image receptive members loaded. Upon such detection, additional image receptive members may be supplied to effect smooth and continued image recording operation. Based on the detection of a shortage or no remaining image receptive member, the supply of the photosensitive member for exposure may be stoped so that wasteful exposure of the photosensitive member can be prevented. The image recording device of the present invention is inexpensive because he arrangement is simple, and it is not necessary to have data on the number of image receptive members stored or to use special image receptive members having shorting detecting means.

Although a certain preferred embodiment has been shown and described, it should be understood that many changes and modifications may be made therein without departing from the scope of the appended claims.

What is claimed is:

1. An image recording device for forming an image on an image receptive member, comprising:

a casing for storing a stack of image receptive members;

delivery means for delivering one image receptive member at a time from said casing;

a movable plate disposed in said casing and displaceable toward said delivery means as the number of the image receptive members in said casing is reduced;

a detector mechanism for detecting a predetermined amount of displacement of said movable plate; and transferring means for transferring an image recorded on a photosensitive member to the image receptive member delivered by said delivery means, wherein said detector mechanism comprises a substantially straight arm angularly movably supported and having an end displaceable in response to displacement of said movable plate, and detecting means for detecting a predetermined amount of displacement of said arm comprising a pair of support plates defining a slit therebetween into which an opposite end of said arm can enter, and a light-emitting element and a light detector supported respectively on said support plates in confronting relation.

2. An image recording device according to claim 1, wherein said movable plate is angularly movable about one end thereof in said casing, further including a resilient member for normally urging an opposite end of said movable plate toward said delivery means, said image receptive members being stacked on an upper surface of said movable plate.

3. An image recording device according to claim 2, wherein said resilient member comprises a conical coil spring progressively smaller in diameter toward said delivery means.

4. An image recording device according to claim 2, wherein said casing has a tooth disposed on an upper edge thereof near said opposite end of said movable plate for engaging an end of an uppermost one of said image receptive members.

5. An image recording device according to claim 1, wherein said detecting means is positionally adjustable in a direction in which said opposite end of the arm is displaceable.

6. An image recording device according to claim 1, wherein said movable plate has a tongue projecting from one side thereof, said end of said arm being held against said tongue.

7. An image recording device according to claim 1, further comprising a baising spring connected to said opposite end of said arm for pulling said opposite end upwardly.

8. An image recording device according to claim 1, wherein said arm is angularly movably supported centrally thereof.

* * * * *